US008480514B2

(12) United States Patent
Hartwell et al.

(10) Patent No.: US 8,480,514 B2
(45) Date of Patent: Jul. 9, 2013

(54) GOLF CLUB HAVING AN IMPROVED FACE INSERT

(75) Inventors: Bradford Hughes Hartwell, Encinitas, CA (US); Uday V. Deshmukh, Carlsbad, CA (US)

(73) Assignee: Acushnet Company, Fairhaven, MA (US)

( * ) Notice: Subject to any disclaimer, the term of this patent is extended or adjusted under 35 U.S.C. 154(b) by 309 days.

(21) Appl. No.: 12/850,007

(22) Filed: Aug. 4, 2010

(65) Prior Publication Data

US 2012/0034991 A1 Feb. 9, 2012

(51) Int. Cl.
*A63B 53/04* (2006.01)

(52) U.S. Cl.
USPC ..... 473/342; 473/350

(58) Field of Classification Search
USPC ..... 473/342, 345–346, 349–350
See application file for complete search history.

(56) References Cited

U.S. PATENT DOCUMENTS

| | | | | |
|---|---|---|---|---|
| 4,812,187 | A * | 3/1989 | Honma | 156/245 |
| 5,016,883 | A * | 5/1991 | Kobayashi | 473/347 |
| 5,405,137 | A | 4/1995 | Vincent et al. | |
| 5,407,202 | A | 4/1995 | Igarashi | |
| 5,766,094 | A | 6/1998 | Mahaffey et al. | |
| 5,890,973 | A | 4/1999 | Gamble | |
| 6,050,904 | A * | 4/2000 | Kuo | 473/342 |
| 6,364,789 | B1 * | 4/2002 | Kosmatka | 473/329 |
| 6,402,636 | B1 * | 6/2002 | Chang | 473/324 |
| 6,648,774 | B1 * | 11/2003 | Lee | 473/342 |
| 6,743,117 | B2 * | 6/2004 | Gilbert | 473/332 |
| 6,814,674 | B2 | 11/2004 | Clausen et al. | |
| 6,951,518 | B2 | 10/2005 | Solheim et al. | |
| 7,025,693 | B2 | 4/2006 | Sugimoto | |
| 7,086,961 | B2 | 8/2006 | Wright et al. | |
| 7,101,290 | B2 | 9/2006 | Tucker, Sr. | |
| 7,112,147 | B2 | 9/2006 | Solheim et al. | |
| 7,399,238 | B2 | 7/2008 | Hocknell et al. | |
| 7,585,232 | B2 * | 9/2009 | Krumme | 473/329 |
| 7,614,962 | B1 | 11/2009 | Clausen | |
| 8,210,965 | B2 * | 7/2012 | Roach et al. | 473/329 |
| 2004/0180730 | A1 | 9/2004 | Franklin et al. | |
| 2005/0020378 | A1 * | 1/2005 | Krumme et al. | 473/332 |
| 2005/0164806 | A1 | 7/2005 | Solheim et al. | |
| 2006/0073912 | A1 * | 4/2006 | Hsieh et al. | 473/350 |
| 2007/0129168 | A1 * | 6/2007 | Matsunaga et al. | 473/349 |
| 2007/0178990 | A1 * | 8/2007 | Tsai | 473/345 |
| 2011/0319188 | A1 * | 12/2011 | Narita et al. | 473/329 |
| 2012/0258820 | A1 * | 10/2012 | Roach et al. | 473/332 |

FOREIGN PATENT DOCUMENTS

JP 2007117472 A * 5/2007

* cited by examiner

*Primary Examiner* — Stephen L. Blau
(74) *Attorney, Agent, or Firm* — Randy K. Chang

(57) ABSTRACT

A golf club head with an improved face insert is disclosed herein. More specifically, the present invention discloses a golf club head wherein the face insert has a cavity near the top surface of the face insert that extends vertically downward towards the bottom surface of the face insert while terminating short of the bottom surface. The face insert having the cavity serves to remove unnecessary weight from the upper surface weight of the face insert; while the cavity that terminates short of the bottom surface yields a solid face insert near the bottom surface to preserve the structural integrity of the face insert where the golf club head impacts a golf ball. The cavity created within the face insert may be filled in with a lightweight material that helps further maintain the structural integrity of the entire face insert while still removing unnecessary weight from the face insert.

14 Claims, 7 Drawing Sheets

GOLF CLUB HAVING AN IMPROVED FACE INSERT

FIELD OF THE INVENTION

The present invention relates generally to a golf club head having an improved face insert. More specifically, the present invention relates to a golf club head with a face insert that improves the performance of the golf club head by removing unnecessary weight near the top surface of the face insert while preserving the structural integrity of the face insert near the bottom surface of the face insert, where the golf club head impacts a golf ball. The face insert disclosed by the present invention may generally have a cavity beginning near a top surface of the face insert that extends vertically into the body of the face insert terminating short of the bottom surface of the face insert; wherein the cavity may be filled with a secondary material having a second density lower than the first density of the first material used to construct the remainder of the face insert.

BACKGROUND OF THE INVENTION

In order to improve the performance of a golf club, golf club designers constantly struggle with ways to design a golf club that could hit a golf ball longer and straighter. Despite all the benefit generally associated with being able to hit a golf ball the longer, most golfers will agree that it is the ability to hit a golf ball straighter that most dramatically increases a golfer's ability to obtain a low score. Hence, in order to hit a golf ball straighter, golf club designers have struggled with the ability of a golf club to produce a relatively straight flight even when the golf ball is not struck at the center of the golf club head; as a golf ball struck at the center of the face of the golf club head tends to already have a relatively straight flight path. In order to design a golf club that tends to be more forgiving on off-center hits, the Center of Gravity (CG) location of the golf club head as well as the Moment of Inertia (MOI) are often two of the most important factors that can help achieve such a straighter flight.

Although numerous methods can be used to improve the CG and MOI of a golf club head, one of the most effective ways to improve such a performance is by removing weight from unnecessary areas of the golf club head and placing it at alternative locations within the golf club head. U.S. Pat. No. 5,407,202 to Igarashi ('202 Patent) gives one example of such an attempt by disclosing a golf club head having a face insert that is made of a high strength lightweight metals such as titanium, allowing the weight saved to be distributed around the perimeter of the golf club head to improve the MOI of the golf club head.

U.S. Pat. No. 5,405,137 to Vincent et al. ('137 Patent) further demonstrates the applicability of this concept into a metal wood type golf club head to increase the performance of such a metal wood type golf club head. More specifically, the '137 Patent discloses a golf club head comprising a body and a face insert that is positioned in a recess provided on the front part of the body, wherein the recess comprises of a plurality of abutments so as to create a stable support for the insert in the recess.

In an alternative situation, U.S. Pat. No. 6,814,674 to Clausen et al. ('674 Patent) shows how a face insert could be used in a iron type golf club head to improve the performance of a golf club head. More specifically, the '674 Patent discloses an iron type golf club head composed of three main components: a periphery member, a central member, and a face plate; wherein the iron type golf club head has a high moment of inertia.

Despite all the advancements in incorporating a face insert within a golf club head to improve the performance of a golf club head, the current art fails to truly maximize the opportunity to manipulate the composition and geometry of the face insert itself to further improve the performance of the golf club head. Even though replacing the striking face of the golf club with a face insert with a different insert that is constructed out of a lighter material will allow for significant weight savings, further weight savings and optimization of weight location could be accomplished by adjusting composition and geometry of the face insert itself.

U.S. Pat. No. 5,766,094 to Mahaffey et al. ('094 Patent) discloses an example of an early attempt to improve the performance of a golf club head by reducing unnecessary weight within the face insert itself. However, the method disclosed in '094 Patent may not be optimal as it uniformly removes weight from the face insert by creating cavity throughout the entire face insert itself. Uniformly moving weight from a face insert is undesirable because it fails to consider the strength and durability needs of the face insert itself. Because the face insert of a golf club head is the portion of the golf club head that is subjected to the most stress, sacrificing strength and durability at such a location may generally be an undesirable solution to save weight.

Hence, as it can be seen from above, despite all the advancement in golf club technology, the current art has been unable to sufficiently improve upon the performance advantages achievable by utilizing a face insert within a golf club head. Furthermore, the current art's attempt to improve upon the performance of a golf club head by focusing on the face insert itself is undesirable because it does so by uniformly taking away material within the face insert itself at the expense of sacrificing strength and durability. Ultimately, it can be seen from above that there is a need in the art to further improve upon the performance of a golf club head by focusing on improving the face insert without sacrificing the strength and durability of such a face insert.

BRIEF SUMMARY OF THE INVENTION

One aspect of the present invention is a golf club head comprising a face insert located at a frontal portion of the golf club head for striking a golf ball together with a body located at an aft portion of the golf club head. The body portion has a recessed portion wherein the recessed portion delimits the face insert such that the face insert rests within the recessed portion of the body. The face insert further comprises a core member and a cavity. The cavity is located at the top surface of the face insert extending into the face insert towards the bottom surface of the face insert, terminating short of the bottom surface.

In another aspect of the present invention is a golf club head comprising a body located at an aft portion of the golf club head having a recessed portion near a frontal portion of the body, and a face insert being of a similar size and shape to said recessed portion connected to the body within the recessed portion. The face insert further comprises a core member and a filler member. The core member, made out of a first material, has a cavity near a top surface of the face insert; while the filler member, made out of a second material, fills in the cavity of the core member. The first material has a first density and the second material has a second density, wherein the second density is lower than the first density.

In a further aspect of the present invention is a set of iron-type golf clubs comprising a first golf club head and a second golf club head. The first golf club head has a first loft wherein the first golf club head further comprises a first face insert having a first density, wherein the first cavity has a first volume. The second golf club head has a second loft wherein the second golf club head further comprises a second face insert having a second density, wherein the second cavity has a second volume. The first loft is greater than the second loft and the second volume is greater than the first volume.

These and other features, aspects and advantages of the present invention will become better understood with reference to the following drawings, description and claims.

BRIEF DESCRIPTION OF THE DRAWINGS

The foregoing and other features and advantages of the invention will be apparent from the following description of the invention as illustrated in the accompanying drawings. The accompanying drawings, which are incorporated herein and form a part of the specification, further serve to explain the principles of the invention and to enable a person skilled in the pertinent art to make and use the invention.

DETAILED DESCRIPTION OF THE INVENTION

The following detailed description describes the best currently contemplated modes of carrying out the invention. The description is not to be taken in a limiting sense, but is made merely for the purpose of illustrating the general principles of the invention, since the scope of the invention is best defined by the appended claims.

Various inventive features are described below and each can be used independently of one another or in combination with other features. However, any single inventive feature may not address any or all of the problems discussed above or may only address one of the problems discussed above. Further, one or more of the problems discussed above may not be fully addressed by any of the features described below.

Figure 1:
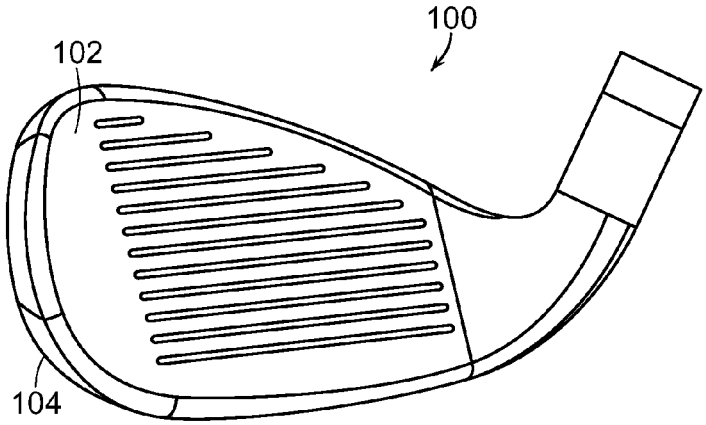
FIG. 1 shows a perspective view of a golf club head in accordance with an exemplary embodiment of the present invention.

FIG. 1 of the accompanying drawings shows a perspective view of a golf club head 100 in accordance with an exemplary embodiment of the present invention. More specifically, golf club head 100 shown in FIG. 1 may have a face insert 102 that is located at a frontal portion of the golf club head that can be used for striking a golf ball. The face insert 102, as shown in this current exemplary embodiment, may generally be connected to the frontal portion of a body 104 of the golf club head 100 in a way that the body 102 makes up the aft portion of the golf club head 100 to provide structural support for the face insert 102 itself.

Figure 2:
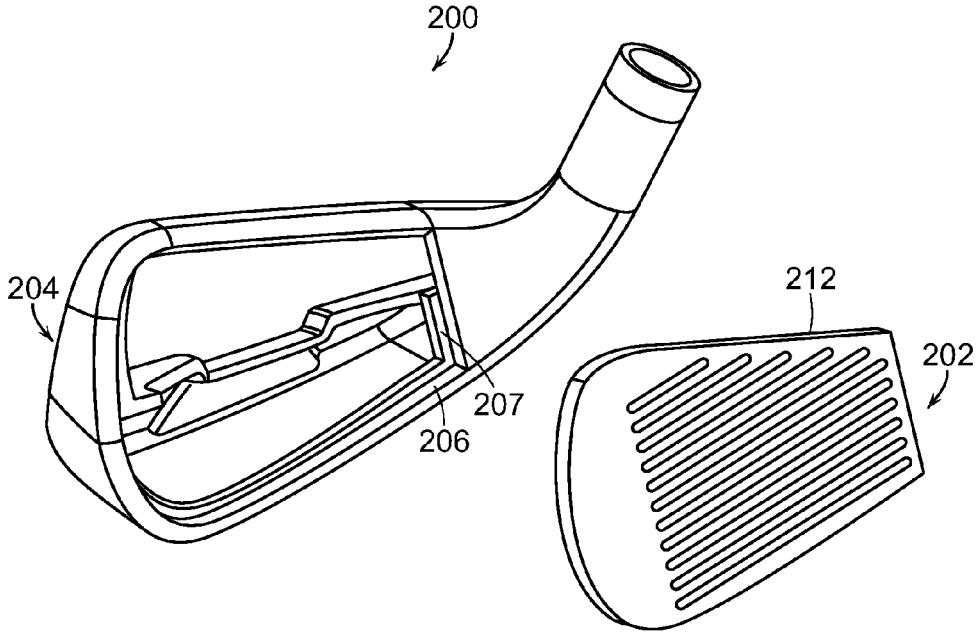
FIG. 2 shows an exploded perspective view of a golf club head in accordance with an exemplary embodiment of the present invention.

Although the perspective view of the golf club head 100 shown in FIG. 1 shows an assembled view of the golf club head 100, the exploded view of golf club head 200 in FIG. 2 allows a clearer view of the connection between the face insert 202 with the body 204. More specifically, the exploded view of golf club head 200 shows the body 204 of the golf club head 200 having a recessed portion 206 that creates a pocket within the body 204 that matches in size and shape with the perimeter of the face insert 202. Alternatively speaking, it can be stated that the recessed portion 206 delimits the face insert 202 such that the face insert 202 rests within the recessed portion 204 of the golf club head 200 without departing from the scope and content of the present invention. In addition to showing the recessed portion 206, the exploded view of the golf club head 200 also shows a backing portion 207 to the recess portion 206, wherein the backing portion 207 provides a backstop to the face insert 202 as it is inserted into the recessed portion 204.

The exploded view of golf club head 200 shown in FIG. 2 of the accompanying drawings also may also show a cavity 212 within the face insert 202 in order to improve the overall performance of the golf club head 200. Cavity 212, as shown in the current exemplary embodiment, may generally be formed near the top surface of the face insert 202 extending vertically downward into the body of the face insert 202 towards the bottom surface of the face insert 202. Having a cavity 212 in this orientation improves the performance of the golf club head 200 by removing unnecessary weight from portions of the face insert 202 that is not subjected to the highest stresses, allowing this weight to be repositioned at a more optimal position within body 204 of the golf club head.

Figure 3:
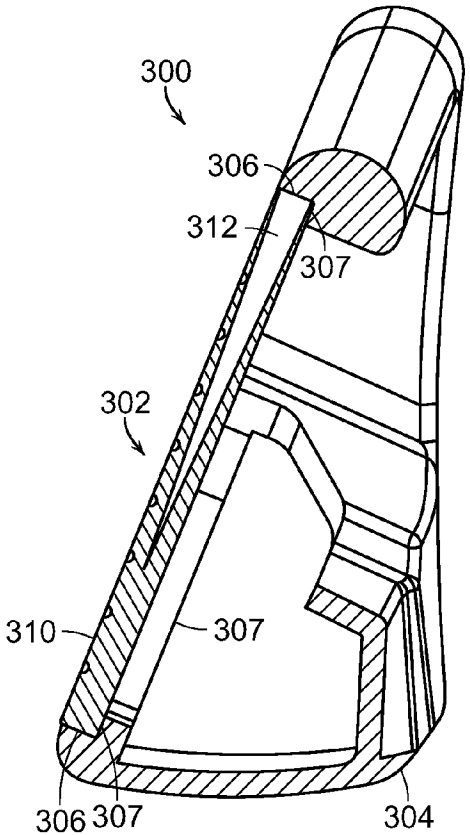
FIG. 3 shows a cross-sectional view of a golf club head in accordance with an exemplary embodiment of the present invention taken along the middle of the golf club head.

FIG. 3 of the accompanying drawings shows a cross-sectional view of the golf club head 300, taken down the middle of the golf club head 300, in accordance with an exemplary embodiment of the present invention. It should be noted that all subsequent cross-sectional view of golf club heads will be taken down the middle of the golf club head, and all dimensional references will be referring to the measurement of the various dimensions at the mid point of the golf club head viewed from this cross-sectional line. The cross-sectional view of golf club head 300 allows for a clearer view of the cavity 312 within the face insert 302 as well as how the face insert 302 fits within the recessed portion 306 of the body 304. More specifically, FIG. 3 shows how the recessed portion 306 creates a pocket for the face insert 302 and demits the face insert so that it rests within the recessed portion 306. It should be noted that the recessed portion 306 works in conjunction with the backing portion 307 to fully create a pocket that supports the face insert 302 without departing from the scope and content of the present invention. In addition to the above, it should be noted that the cavity 312 within the face insert 302 essentially divides the face insert 302 in to a solid core member 310 and a hollow cavity 312 to improve the performance of the golf club head 300 as mentioned above.

Figure 4:
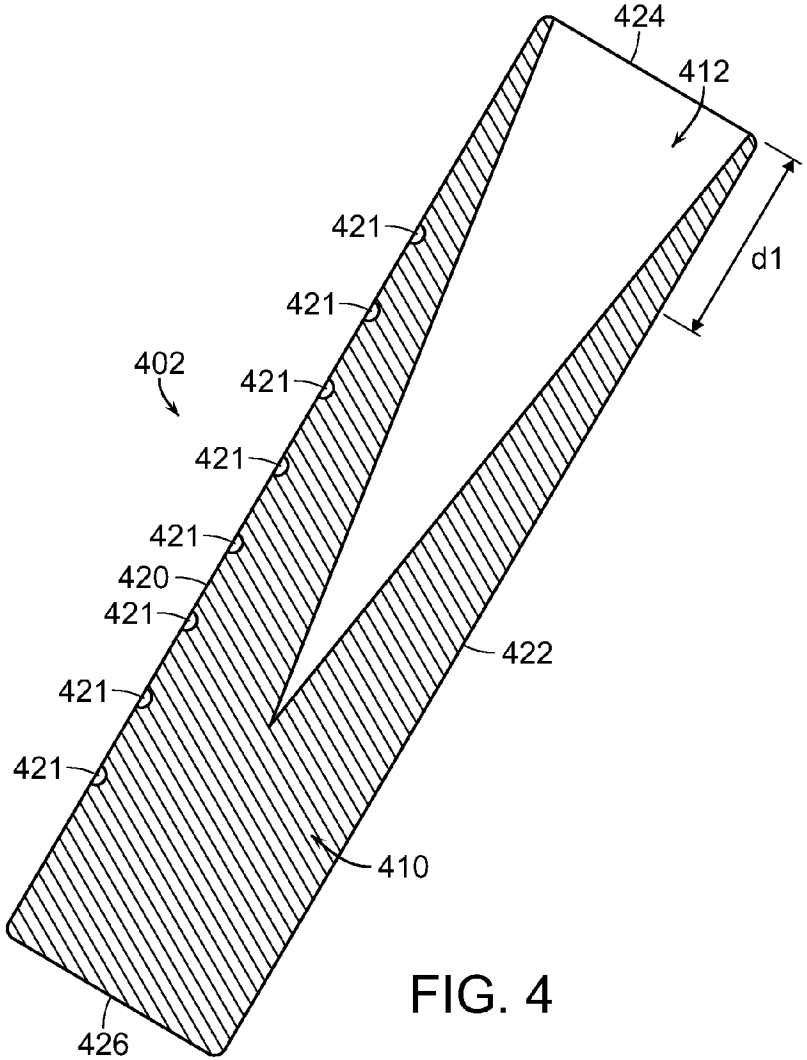
FIG. 4 shows an enlarged cross-sectional view of an face insert in accordance with an exemplary embodiment of the present invention.

In order to provide a clearer view of the relationship between the core member 310 and the cavity 312 of the face insert 302, FIG. 4 is provided to show an enlarged cross-sectional view of the face insert 302 originally shown in FIG. 3. Face insert 402 shown in FIG. 4 may generally have a frontal surface 420 containing a plurality of scorelines 421, a rear surface 422 directly parallel to the frontal surface 420 and behind the frontal surface 420, a top surface 424 perpendicular to the frontal surface 420 and the rear surface 422 near the top of the face insert 402, and a bottom surface 426 also perpendicular to the frontal surface 420 and the rear surface 422 near the bottom of the face insert 402. The various surfaces 420, 422, 424, and 426 help provide a frame of reference for the orientation and direction of the cavity 412 within the face insert 402. In this exemplary embodiment, the cavity 412 is formed at the top surface 424 of the face insert 402 and extends vertically into the face insert 402 towards the bottom surface 426 of the face insert 402, terminating short of the bottom surface 426.

FIG. 4 of the accompanying drawings also shows how the cavity 412 bifurcates the face insert 402 into a core member 410 and the cavity 412. As indicated above, the bifurcation of the face insert 402 into a core member 410 and a cavity 412 helps retain the strength and durability of the face insert 402 near the bottom surface 426 of the golf club head while removing weight near the top surface 424 of the golf club head. Retaining the strength and durability of the face insert 402 near the bottom surface 426 may be desirable because it is generally the location where the face insert 402 impacts a golf ball, hence it is also the portion of the face insert 402 that is subjected to the most stress. Removing weight near the top surface 424 of the face insert 402 of the golf club head 400 may be desirable because that portion of the face insert 402 does not generally impact a golf ball; hence it is also the portion of the face insert 402 that is subjected to the least amount of stress.

In order to quantify the bifurcation of the face insert 402 into the core member 410 and the cavity 412, a relative thickness ratio is created to determine that is derived from the relative thicknesses of the core member 410 to the cavity 412. More specifically, the relative thickness ratio may be defined as the thickness of the cavity 412 divided by the thickness of the core member 410 at a distance d1 of ½ an inch away from the top surface 424 of the golf club head shown below in Eq. (1):

$$\text{Thickness Ratio} = \frac{\text{Thickness of Cavity}}{\text{Thickness of Core Member}} \qquad \text{Eq. (1)}$$

In one exemplary embodiment of the present invention, the face insert 402 of the golf club head may have a thickness ratio of greater than about 0.20 and less than about 0.80, more preferably greater than about 0.30 and less than about 0.80, and most preferably greater than about 0.40 and less than about 0.80.

Although the thickness ratio discussed above may shed an insight on the amount of weight that can be removed from the cavity 412 of the face insert 402, it may also help in quantifying the size and shape of the cavity 412. More specifically, the cavity 412 shown in this embodiment of the present invention may generally be the thickest near the top surface 424, while constantly decreasing in thickness as it gets closer to the bottom surface 426. Alternatively speaking, the thickness ratio of the face insert 402 is the highest near the top surface 424 and the thickness ratio of the face insert 402 changes and decreases from the top surface 424 towards the bottom surface 426. It should also be noted that in this exemplary embodiment of the present invention, the thickness ratio of the face insert 402 may decreases linearly starting from said top surface 424 towards said bottom surface 426 to smooth transition the change in the thickness ratio.

Figure 5:
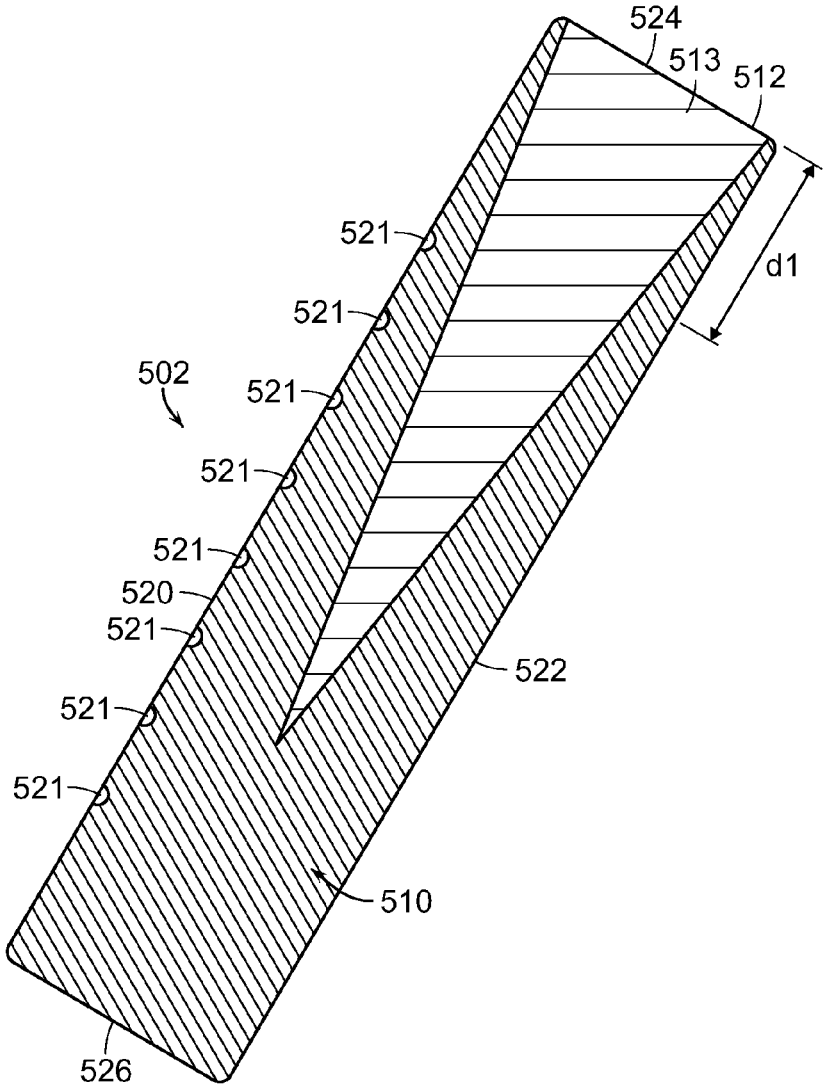
FIG. 5 shows an enlarged view of a cross-sectional view of a face insert in accordance with an exemplary embodiment of the present invention.

Although the cavity 412 shown in FIG. 4 may be hollow, in a preferred embodiment of the present invention, the cavity 412 may be filled with a lightweight material that provides both weight savings benefits as well as some additional level of structural support of the face insert 402 near the top surface 424, especially when compared to a purely hollow cavity 412. FIG. 5 of the accompanying drawings provides a cross-sectional view of a face insert 502 in accordance with the preferred embodiment of the present invention wherein the cavity 512 is filled in with a lightweight material 513 that is capable of providing some additional level of structural support as well as removing weight from the cavity 512 portion of the face insert 502. More specifically, the core member 510 may generally be made out of a first material while the cavity 512 may generally be filled with a second material that is different from the first material. Alternatively speaking, the face insert 502 may be classified into two separate and distinct components, a core member 510 and a filler member 513 in this embodiment of the present invention.

Because the first material may generally need to strong enough to withstand the impact forces with a golf ball, the first material may generally have a higher density, while the second material used to remove weight near the top surface 524 of the face insert may generally have a lower density. More specifically, the first material, as disclosed in this current exemplary embodiment, may generally be steel or titanium for its strength and durability characteristics; however, numerous other materials may be used so long as it provides sufficient strength to withstand the impact forces with a golf ball all without departing from the scope and content of the present invention. The second material used to create the filler member 513 within the cavity 512, on the other hand, may generally be a composite type material, an aluminum type material, a rubber type material, a plastic type material, or any other type of material that has a lower density than the first material without departing from the scope and content of the present invention. This filler member 513, in addition to provide significant weight savings, could also provide additional benefit that could also provide vibration dampening characteristics without departing from the scope and content of the present invention.

Figure 6C:
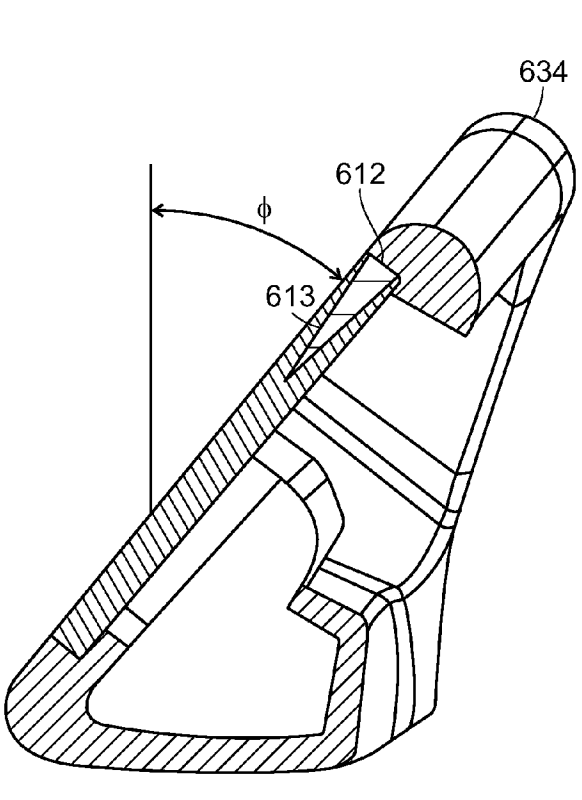
FIG. 6*c* shows an cross-sectional view of a golf club head having a loft $\Phi$ in accordance with an exemplary embodiment of the present invention taken along the middle of the golf club head.
Figure 6B:
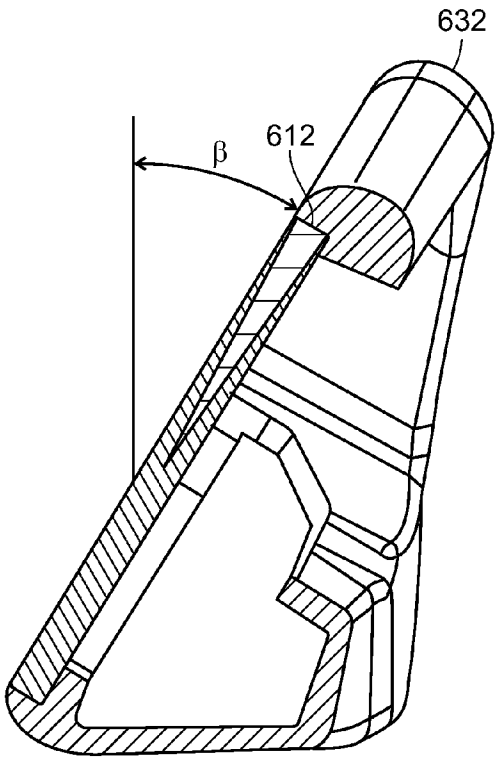
FIG. 6*b* shows an cross-sectional view of a golf club head having a loft $\beta$ in accordance with an exemplary embodiment of the present invention taken along the middle of the golf club head.
Figure 6A:
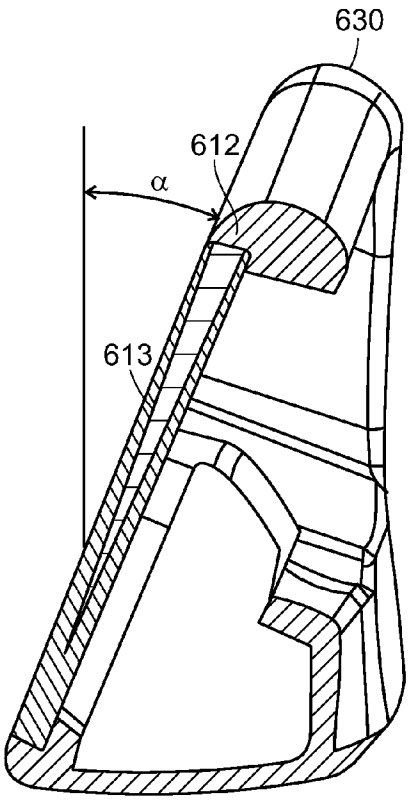
FIG. 6*a* shows an cross-sectional view of a golf club head having a loft $\alpha$ in accordance with an exemplary embodiment of the present invention taken along the middle of the golf club head.

FIGS. 6*a*, 6*b*, and 6*c* of the accompanying drawings show cross-sectional views of a plurality of golf club head included in a set of irons in accordance with an alternative embodiment of the present invention. More specifically, FIG. 6*a* relates generally to a long iron type golf club head in accordance with an exemplary embodiment of the present invention having a loft of about α, FIG. 6*b* relates generally to a middle iron type golf club head in accordance with an exemplary embodiment of the present invention having a loft of about β, and FIG. 6*c* relates generally to a short iron type golf club head in accordance with an exemplary embodiment of the present invention having a loft of about Φ. Loft angle α may generally be less than loft angle β, which is even less than loft angle Φ. It is worth noting here that FIGS. 6*a*, 6*b*, and 6*c* show a progressive change in the size of the cavity 612 that varies with the different lofts in order to adjust for the various amount of discretionary weight needed for the various golf club heads.

For example, the long iron golf club 630 shown in FIG. 6*a* may generally have a relatively large cavity 612 filled in with the filler material 613 as longer irons may generally require a lower CG to get the golf club underneath the golf ball as well as provide more forgiveness by placing the discretionary weight saved from the face insert 630 elsewhere to improve the MOI. The middle iron golf club 632 shown in FIG. 6*b* may generally have a medium sized cavity 612 filled in with the filler material 613 to strike a middle ground between weight savings and performance gains. The short irons golf club 634 shown in FIG. 6*c* may generally have a smaller sized cavity 612 filled in with the filler material 613 to provide less discretionary weight, as shorter irons do not need as low of a CG nor does it require as much forgiveness. Alternatively speaking, the size of the cavities 612 may be quantified by a specific volume, which changes depending on the loft α, β, and Φ of the various iron-type golf clubs. More specifically, the volume of the cavities 612 may change inversely with the lofts α, β, and Φ of the various iron-type golf club throughout the set in such a way that the volume of the cavities 612 will decrease when the loft α, β, and Φ of the iron-type golf clubs increase. In this exemplary embodiment of the present invention, golf club 634 may have a first loft that is greater than a second loft of golf club 632, yielding a second volume that is greater than the first volume.

Figure 7:
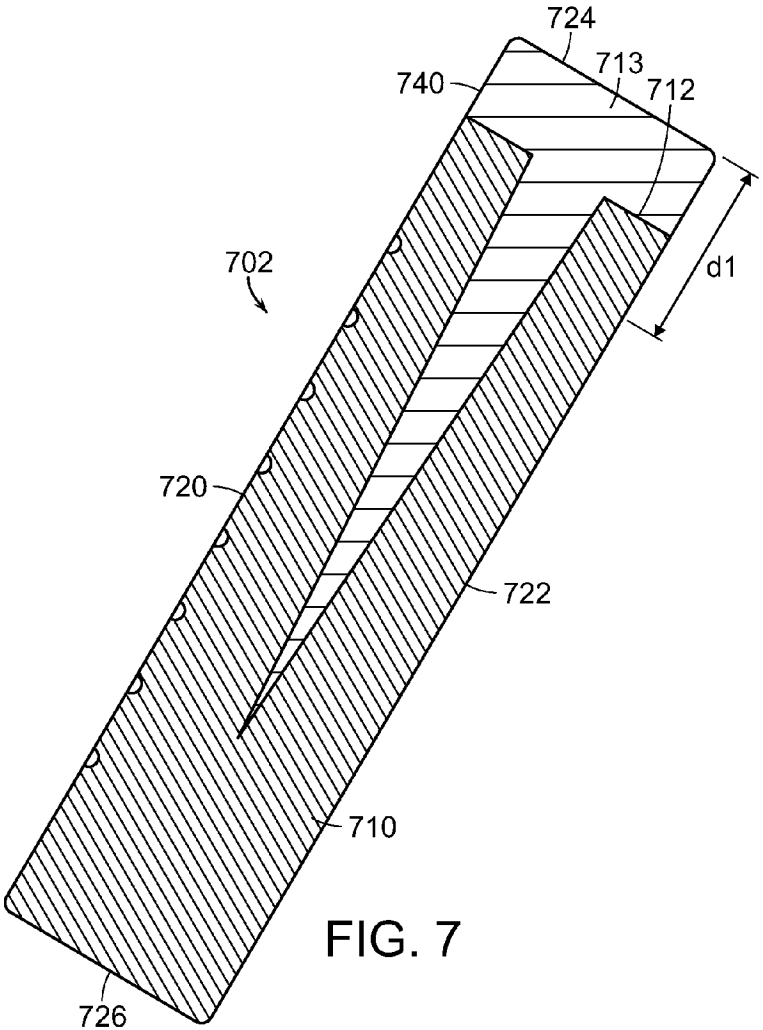
FIG. 7 shows an enlarged cross-sectional view of a face insert in accordance with an exemplary embodiment of the present invention.

FIG. 7 of the accompanying drawings shows a cross-sectional view of a face insert 702 in accordance with an alternative embodiment of the present invention wherein the cavity 712 formed within the face insert 702 may have a cap 740 near the top surface 724 of the face insert 702. Having a cap 740 in this alternative embodiment of the present invention is advantageous when the cavity 712 is filled with the filler material 713 because it provides more retention forces. The cap 740, as shown in this current exemplary embodiment, may help retain the filler material 713 within the cavity 712 by providing more surface area for bonding between the filler material 713 and the core member 710. Although a separate figure is not used to show in detail the variations of the size of the cavity 712 and it's accompanying filler material 713 throughout a set of iron type golf clubs, the size of the cavity 712 having a cap 740 could also change to correspond to the various needs of the various golf club heads that have different lofts as previously illustrated in FIG. 6.

Figure 8:
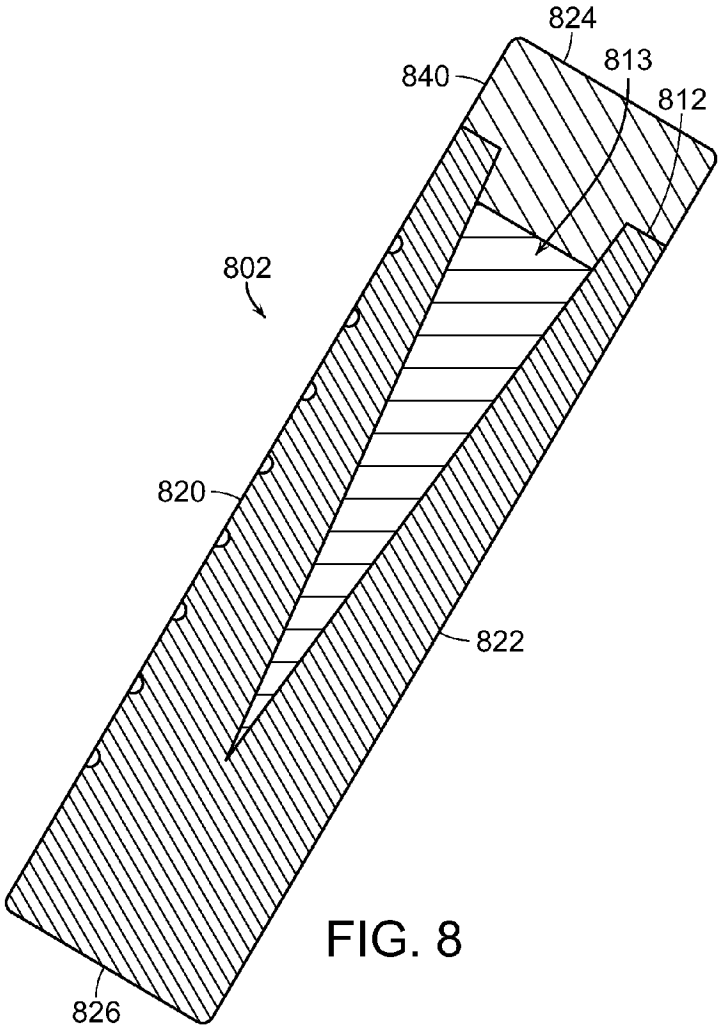
FIG. 8 shows an enlarged cross-sectional view of a face insert in accordance with an exemplary embodiment of the present invention.

FIG. 8 of the accompanying drawings shows a cross-sectional view of a face insert 802 in accordance with an alternative embodiment of the present invention wherein the cavity 812 formed within the face insert 802 may have a cap 840 that is filled in with a different material than the filler material 813. Filling the cavity 812 with two different materials may offer fine tune weight adjustment capabilities within the face insert 802, which may be beneficial in certain situations requiring such a minute adjustment. Similar to the prior discussion above regarding the variations in the size and depth of the cavity 812 may have different sizes throughout the different lofts within a set of iron type golf club heads, the size and depth of the cavity 812 in accordance with this embodiment could vary throughout a set of irons to maximize the performance.

Figure 9:
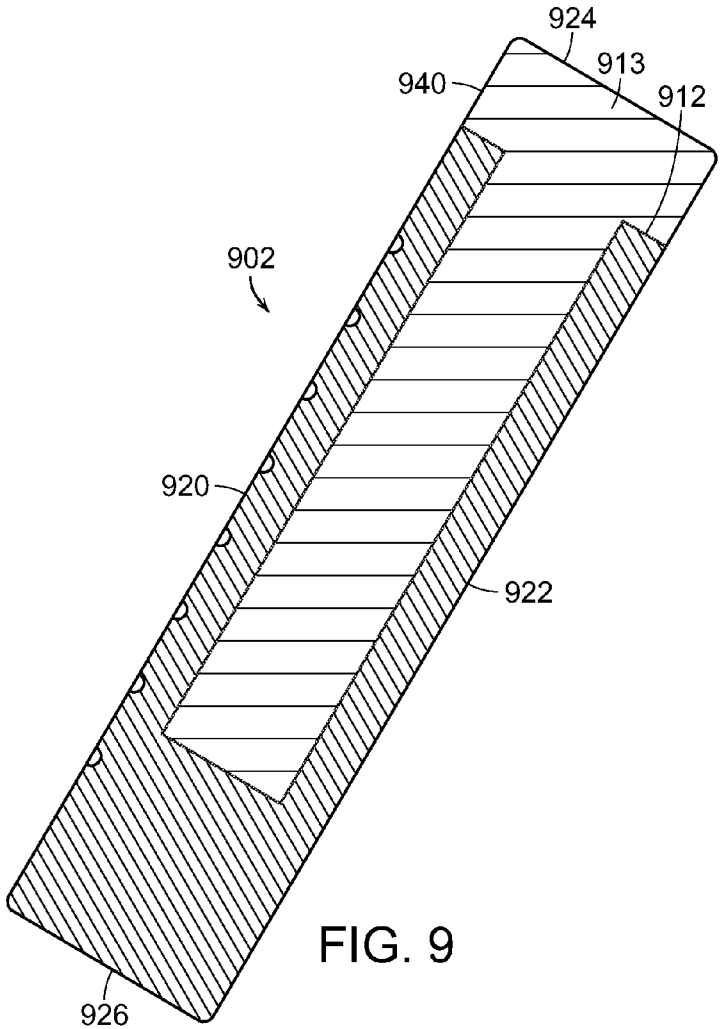
FIG. 9 shows an enlarged cross-sectional view of a face insert in accordance with an exemplary embodiment of the present invention.

FIG. 9 of the accompanying drawings shows a cross-sectional view of a face insert 902 in accordance with an alternative embodiment of the present invention wherein the cavity 912 formed within the face insert 902 may have a more rectangular shape to uniformly remove weight from the face insert 902 without departing from the scope and content of the present invention. The cavity 912 shown in FIG. 9 may also be filled in with a filler material 913 to provide some strength and durability characteristics without departing from the scope and content of the present invention. Similar to the prior discussion above regarding the variations in the size and depth of the cavity 912 may have different sizes throughout the different lofts within a set of iron type golf club heads, the size and depth of the cavity 912 in accordance with this embodiment could vary throughout a set of irons to maximize the performance.

Figure 10:
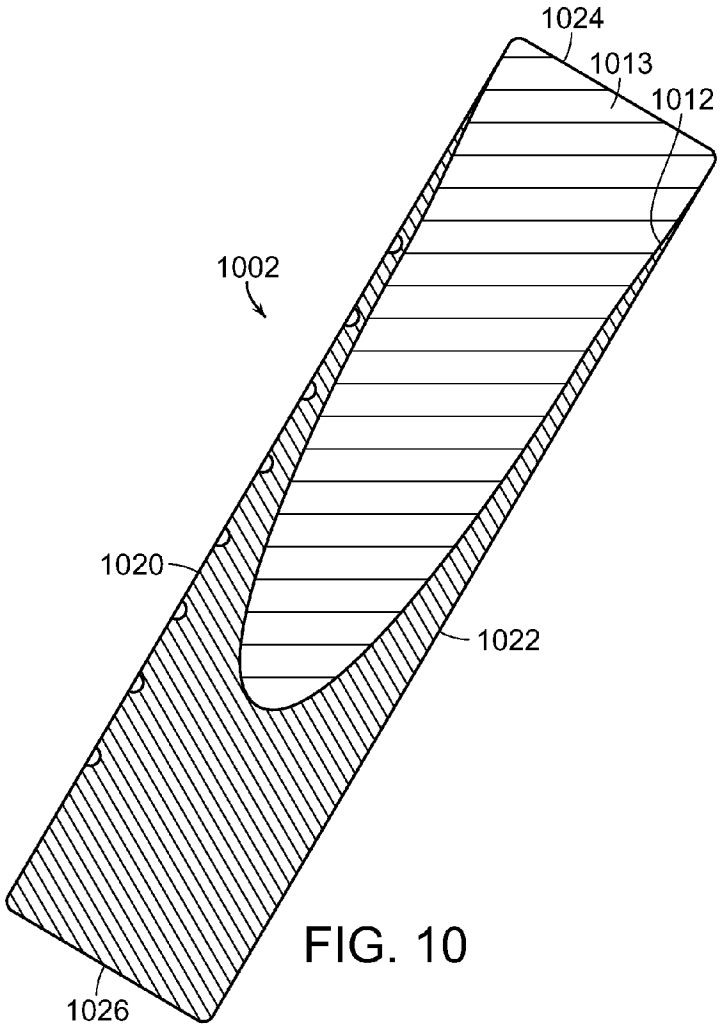
FIG. 10 shows an enlarged cross-sectional view of a face insert in accordance with an exemplary embodiment of the present invention.

FIG. 10 of the accompanying drawings shows a cross-sectional view of a face insert 1002 in accordance with an alternative embodiment of the present invention wherein the cavity 1012 may change its thickness ratio non-linearly from the top surface 1024 towards the bottom surface 1026 without departing from the scope and content of the present invention. Having a non-linear change in the thickness of the cavity 1012 that is filled with the filler material 1013 may be desirable in a face insert 1002 to allow for finer tune adjustment of the strength and durability of the face insert 1002 depending on the point stresses that the face insert 1002 is subjected to at various points. This non-linear change in the face thickness ratio may help optimize the correct balance between weight the strength and durability needed for a face insert 1002 together with the weight savings achievable by such a cavity 1012 that is filled in with the filler material 1013. Similar to the prior discussion above regarding the variations in the size and depth of the cavity 1012 may have different sizes throughout the different lofts within a set of iron type golf club heads, the size and depth of the cavity 1012 in accordance with this embodiment could vary throughout a set of irons to maximize the performance.

Figure 11:
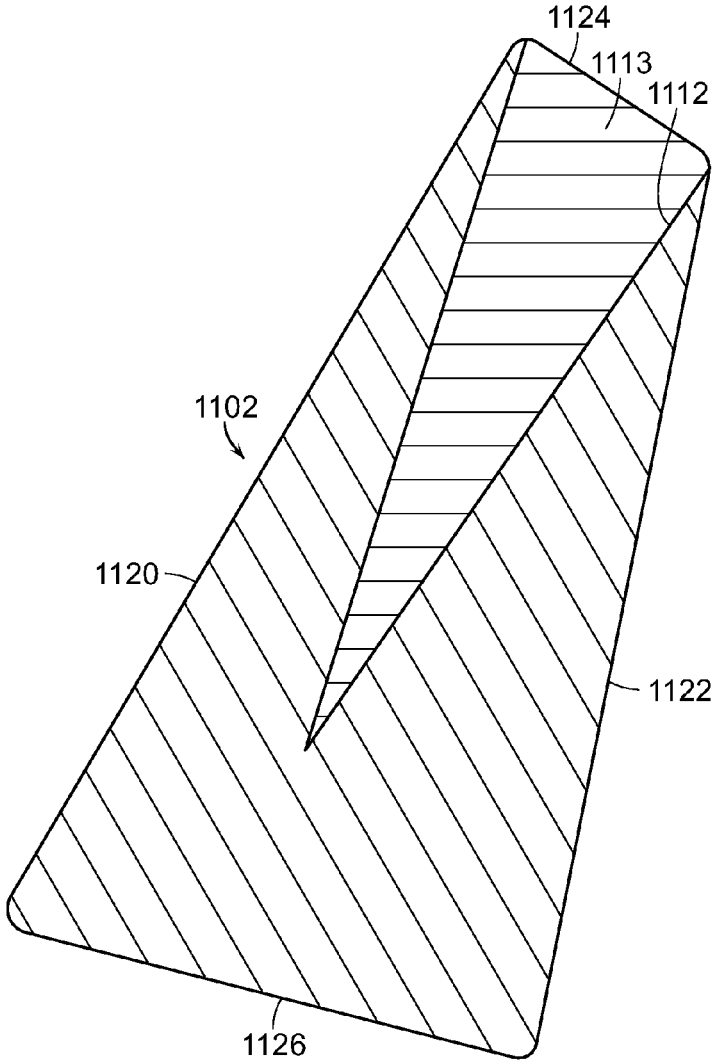
FIG. 11 shows an enlarged cross-sectional view of a face insert in accordance with an alternative exemplary embodiment of the present invention.

FIG. 11 of the accompanying drawings shows a cross-sectional view of a face insert 1102 in accordance with a further alternative embodiment of the present invention wherein the frontal surface 1120 is not parallel with the rear surface 1122. Top surface 1124 may or may not be perpendicular to the frontal surface 1120, and the bottom surface 1126 is not perpendicular to the frontal surface 1120. Although perpendicular surfaces are used in a the preferred embodiment discussed above, the non-perpendicular surfaces may be used to further adjust the various weighting and vibration dampening needs of a golf club head all without departing from the scope and content of the present invention.

Other than in the operating example, or unless otherwise expressly specified, all of the numerical ranges, amounts, values and percentages such as those for amounts of materials, moment of inertias, center of gravity locations, loft, draft angles, various performance ratios, and others in the aforementioned portions of the specification may be read as if prefaced by the word "about" even though the term "about" may not expressly appear in the value, amount, or range. Accordingly, unless indicated to the contrary, the numerical parameters set forth in the above specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

It should be understood, of course, that the foregoing relates to exemplary embodiments of the present invention and that modifications may be made without departing from the spirit and scope of the invention as set forth in the following claims.

What is claimed is:

1. A golf club head comprising:

a face insert located at a frontal portion of said golf club head for striking a golf ball; said face insert has a frontal surface, a rear surface, a top surface, and a bottom surface;

a body located at an aft portion of said golf club head having a recessed portion wherein said recessed portion delimits said face insert such that said face insert rests within said recessed portion of said body; and wherein said face insert further comprises a core member made out of a first material, a cavity at said top surface of said face insert extending vertically into said face insert towards said bottom surface of said face insert and terminating short of said bottom surface, and wherein said cavity is filled in with a second material that is different from said first material and is not the same as a material of said body which forms said recessed portion.

2. The golf club head of claim 1, wherein said first material has a first density and said second material has a second density; said second density is lower than said first density.

3. The golf club head of claim 1, wherein a thickness ratio of said face insert is greater than about 0.20 and less than about 0.80;

wherein said thickness ratio is defined as a thickness of said cavity divided by a thickness of said core member measured at a distance of ½ an inch away from a top surface of said golf club head.

4. The golf club head of claim 3, wherein said thickness ratio of said face insert is greater than about 0.30 and less than about 0.80.

5. The golf club head of claim 4, wherein said thickness ratio of said face insert is greater than about 0.40 and less than about 0.80.

6. The golf club head of claim 3, wherein said thickness ratio of said face insert varies throughout a height of said face insert.

7. The golf cub head of claim 6, wherein said thickness ratio of said face insert is the highest near said top surface.

8. The golf club head of claim 7, wherein said thickness ratio of said face insert decreases starting from said top surface towards said bottom surface.

9. The golf club head of claim 8, wherein said thickness ratio of said face insert decreases linearly from said top surface towards said bottom surface.

10. The golf club head of claim 8, wherein said thickness ratio of said face insert decreases non-linearly from said top surface towards said bottom surface.

11. A golf club head comprising:

a body located at an aft portion of said golf club head having a recessed portion near a frontal portion of said body;

a face insert being of a similar size and shape to said recessed portion connected to said body within said recessed portion;

wherein said face insert further comprises a core member, made out of a first material, having a cavity near a top surface of said face insert, a filler member, made out of a second material, filling in said cavity, and wherein said second material is not the same as a material of said body which forms said recessed portion;

wherein said first material has a first density and said second material has a second density, and said second density is lower than said first density;

wherein a thickness ratio of said face insert is greater than about 0.20 and less than about 0.80, and said thickness ratio is defined as a thickness of said cavity divided by a thickness of said core member; and wherein said thickness ratio of said face insert varies throughout a height of said face insert.

12. The golf club head of claim 11, wherein said cavity extends vertically into said face insert towards a bottom surface of said face insert and terminating short of said bottom surface.

13. The golf club head of claim 11, wherein said thickness ratio of said face insert is the highest near said top surface.

14. The golf club head of claim 13, wherein said thickness ratio of said face insert decreases starting from said top surface towards said bottom surface.

* * * * *